United States Patent [19]

Richardson

[11] Patent Number: 4,768,477

[45] Date of Patent: Sep. 6, 1988

[54] PRESSURIZED IGNITION SYSTEM

[75] Inventor: Ronald D. Richardson, Pekin, Ill.

[73] Assignee: Caterpillar Inc., Peoria, Ill.

[21] Appl. No.: 914,973

[22] Filed: Oct. 3, 1986

[51] Int. Cl.[4] ..... F02P 15/00

[52] U.S. Cl. ..... 123/169 R; 123/169 C; 123/169 PA

[58] Field of Search ..... 123/143 R, 143 C, 169 R, 123/169 C, 169 PA, 169 PH, 594, 563; 60/599

[56] References Cited

U.S. PATENT DOCUMENTS

| | | | |
|---|---|---|---|
| 2,080,495 | 5/1937 | McKone | 123/169 |
| 2,213,478 | 9/1940 | Swanson | 123/143 C |
| 2,310,575 | 2/1943 | Cattaneo . | |
| 2,323,792 | 7/1943 | Cattaneo | 123/169 |
| 2,350,367 | 6/1944 | Peters et al. | 123/169 PH |
| 2,686,510 | 8/1954 | Platner | 123/143 |
| 2,686,511 | 8/1954 | Platner | 123/143 |
| 2,835,724 | 5/1958 | Colbert | 123/143 C |
| 3,110,297 | 11/1963 | Kauffmann et al. | 123/169 R |
| 3,650,249 | 3/1972 | Honda | 123/169 R |
| 3,921,403 | 11/1975 | McInerney et al. | 60/599 |
| 4,483,147 | 11/1984 | Evans et al. | 60/611 |
| 4,497,532 | 2/1985 | Bezusko et al. | 339/112 R |

FOREIGN PATENT DOCUMENTS

| | | |
|---|---|---|
| 272558 | 9/1927 | United Kingdom . |
| 556790 | 10/1943 | United Kingdom . |
| 565853 | 11/1944 | United Kingdom . |
| 579308 | 7/1946 | United Kingdom . |
| 579298 | 7/1946 | United Kingdom . |
| 1028427 | 5/1966 | United Kingdom . |

OTHER PUBLICATIONS

Parts Book, "3512 Natural Gas Engine," published Feb. 1986, Caterpillar Tractor Co., p. 207.

Patent Abstracts of Japan, vol. 9, No. 46, (M-360) (1769), Feb. 27, 1985 & JP, A, 59-185877, Oct. 22, 1984.

Standard Handbook for Electrical Engineers, Eleventh Edition, Copyright 1978, McGraw-Hill Inc., Section 4, Properties of Materials-Insulating Gases, par. 248 through par. 257.

*Primary Examiner*—Andrew M. Dolinar

*Attorney, Agent, or Firm*—Kenneth A. Rhoads

[57] ABSTRACT

The invention relates to a pressurized ignition system for an engine. The service life of the igniter for the engine and high altitude operation of the engine are substantially reduced due to arc-over between the terminal of the igniter and the metallic shell of the igniter or the nearest ground. The service life of the igniter and associated components are affected by the hot, contaminated environment in which they operate. The present pressurized ignition system includes a chamber around at least a portion of the igniter and the chamber pressurized to a value of, for example, about two atmospheres for suppressing arc-over. The chamber is pressurized by an air compressor drivingly connected to the engine with the air cooled by an engine aftercooler. Pressurizing the chamber prevents contaminates from entering or collecting in the chamber and affecting operation of the system. A bleed passage controllably bleeds a portion of the pressurized air from the chamber to cause circulation of cooled air around the igniter and associated components for extended service life.

4 Claims, 2 Drawing Sheets

76
82
84
34
32
36
78
80
102
38
70
48
68
10
92
66
98
26
100
28
60
62
40
30
64
42
12
52
88
72
74
58
56
50
54
44
46
22
16
86
96
20
23
94
18
24
14

PRESSURIZED IGNITION SYSTEM

DESCRIPTION

1. Technical Field

This invention relates generally to an ignition system for an engine, and more particularly, to a pressurrzed ignition system having a pressurized chamber around at least a portion of an igniter for the engine so that any tendency of arc-over of the igniter is suppressed.

2. Background Art

With today's high energy, high voltage ignition systems, the igniter or sparkplug is now the weak link. As the spark gap at the electrode of the igniter erodes by use, the voltage demand to create a spark increases. Eventually, the voltage demand at the electrode will exceed the arc-over resistance of the igniter resulting in abnormal arcing discharges from the terminal post of the igniter to the metallic shell of the igniter or the nearest ground. When this occurs, the igniter must be prematurely replaced to restore the electrode and lower the voltage demand to create a spark.

The arc-over resistance of the igniter lowers dramatically at high altitudes where the dielectric strength of the air is low because of the low atmospheric pressure of the air. It is mentioned here that the Paschen's Law is well known in the art to define a predetermined breakdown voltage. The breakdown voltage between two electrodes in a gaseous atmosphere is a function of the gas pressure and the distance between the electrodes. Accordingly, abnormal discharge such as arc-over tends to occur under high voltage demands and low atmospheric pressure. Arc-over resistance can be so low that engine operation is impossible.

Igniters are inherently located in a contaminated environment that is extremely hot and laden with dust, moisture, oil and combustionable gases all of which significantly reduces the service life of the igniter as well as the life of associated components including couplings, ignition coils, ignition extenders and wiring. Not only does the contaminated environment affect the life of the igniter and components, it pirates the system of electrical energy and if arc-over occurs in these conditions, could result in igniting the combustible atmosphere around the igniter with disastrous results.

Prior art ignition systems have not heretofore provided means to extend igniter life by increasing arc-over resistance of the igniter, suppress arc-over at high altitudes, prevent the accumulation of contaminates around the igniter or provide for igniter and associated component cooling. Typically, igniters have various combinations of braided shielding cables, flexible jackets or tubular adapters. By and large, the primary function of these arrangements are to protect and insulate the igniters. In some instances, such arrangements can be difficult to install especially when the igniter is necessarily located in a cavity formed in th cylinder head of the engine. Moisture, oil and gases can collect in and around the arrangements with no means for dispersing of the contaminates or preventing the accumuluation of the contaminates, nor is there means to cool or suppress arc-over of the igniter.

Accordingly, what is desired is an ignition system for an engine that suppresses arc-over of the igniter, thus extending the service life of the igniter and permitting high altitude operation of the engine. Also, what is desired is an ignition system that prevents the accumulation of contaminates around the igniter than can affect operation and provides for cooling of the igniter and associated components including the coupling, the ignition coil, and the ignition extender.

The present invention is directed to overcome one or more of the problems as set forth above.

DISCLOSURE OF THE INVENTION

In one aspect of the present invention, an ignition sytem for an engine having an engine air inlet manifold, an igniter, and a source of electrical power connected to the igniter, includes pressurizing means for pressurizing the inlet manifold a chamber around at least a portion of the igniter and passage means for communicating pressurized air from the inlet manifold to the chamber to pressurize the chamber so that any tendency of arc-over of the igniter is suppressed.

In another aspect of the invention, an ignition system for an engine having a sparkplug includes a boot adapted to define a pressurized chamber around the sparkplug.

BEST MODE FOR CARRYING OUT THE INVENTION

Figure 1:
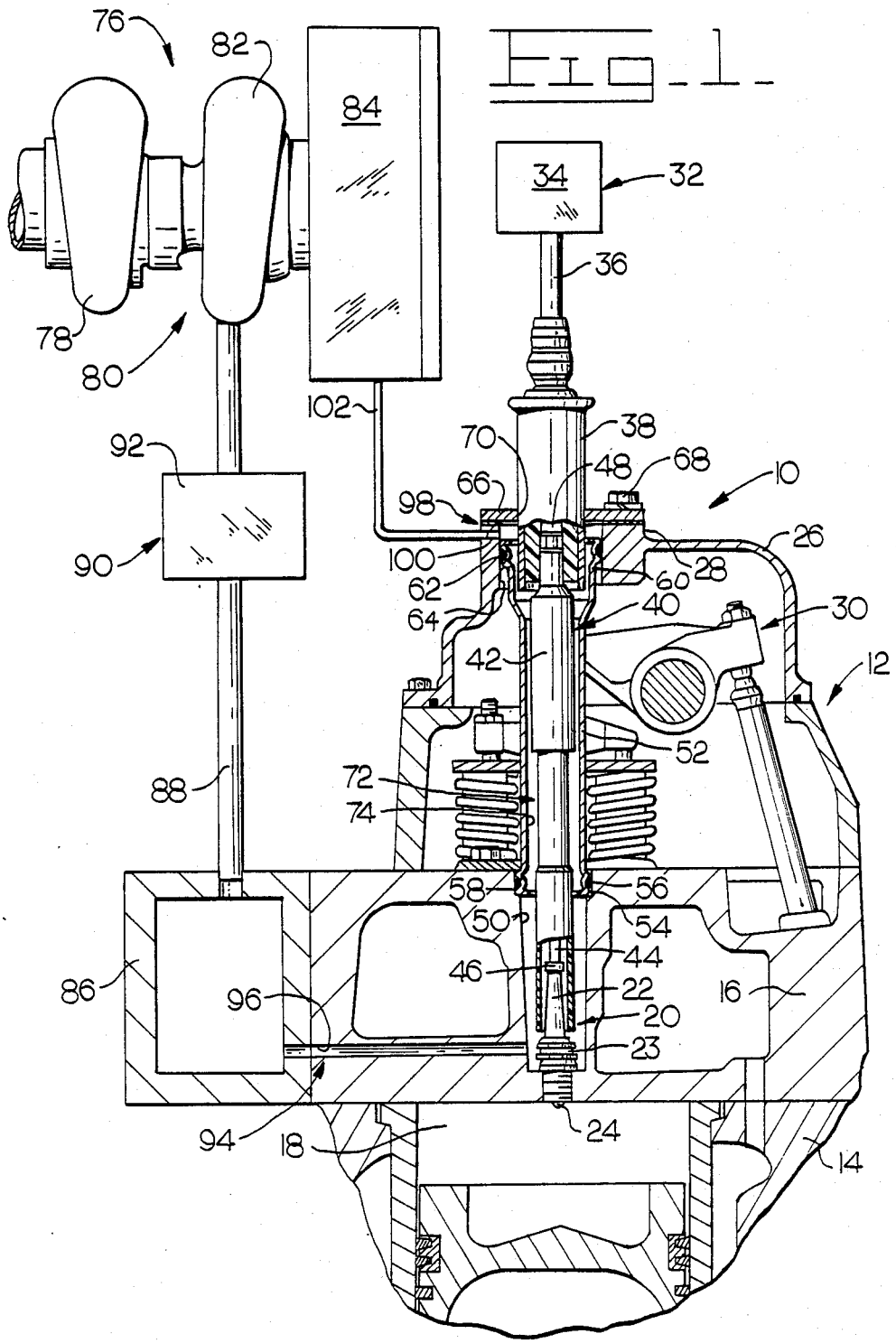
FIG. 1 is a diagrammatic elevational view of an embodiment of the present invention with the engine and pressurized chamber shown in section to better illustrate details thereof.

Referring to FIG. 1 of the drawings, a pressurized ignition system 10 is disclosed for an engine 12 having a block 14, a cylinder head 16 and a plurality of combustion chambers one of which is shown at 18. Each combustion chamber 18 has an igniter 20, in this case a sparkplug 22, having a metallic shell 23 threadably received in the head 16 and extending into the combustion chamber 18 to permit an electrode 24 of the igniter 20 to be exposed therein. A cover 26 having a portion 28 spaced from the igniter 20 encloses a valve operating mechanism 30 for the engine 12.

A source of electrical energy or power 32 includes a low tension generator or magneto 34 connected to a single low tension wire 36, a single high tension ignition coil 38 and coupling means 40 for each of the igniters 20. The coupling means 40 includes an insulated ignition extender 42 or high tension conductor having a conductive core 44 connected between a terminal 46 of the igniter 20 and a contact 48 of the coil 38.

The cylinder head 16 of the engine 12 includes an outwardly facing cavity 50 for receiving and substantially enclosing the igniter 20. A partly tubular element 52 has an end portion 54 and an O-ring seal 56 extending into the cavity 50 sealably mating with a machined bore 58 of the cavity. The tubular element 52 is preferably made of metallic material but alternately can also be made from plastic or other materials having heat resistant, rigid qualities. The tubular element 52 is in substantial alignment with the cavity 50 and connected to the head 16 in substantial coaxial relation with the igniter 20.

An upper end portion 60 of the tubular element 52 having an O-ring seal 62 sealably mates with a bore 64 of the portion 28 of the cover 26 for the engine 12. The bore 64 is sealably closed by a plate 66 that is removably secured to the portion 28 by a plurality of bolts, one of which is shown at 68. The plate 66 has a bore 70 with the coil 38 extending through the bore and being fixably attached to the plate, a portion of the coil 38 extends partially within the tubular element 52 and is in substanial axial alignment with the igniter 20.

The cavity 50, the tubular element 52 and the bore 64 constitute means 72 for defining a generally cylindrical chamber 74 around at least a portion of the igniter 20 including terminal 46. The coupling means 40 and a portion of the coil 32 including the contact 48 are located within the chamber.

The engine 12 further includes a turbocharger 76 having an exhaust driven turbine section 78. The pressurized ignition system 10 further includes a means 80 for pressurizing the chamber 74 to a pressure above atmospheric pressure so that any tendency of arc-over of the igniter 20 is suppressed. The means 80 includes an air compressor section 82 of the turbocharger 76 drivingly coupled to the turbine section 78. Incoming air from an air cleaner 84 is pressurized by the compressor 82 and directed to an inlet manifold 86 for the engine 12 by a passage 88. An apparatus 90 in this case an engine aftercooler 92 is provided in passage 88 for cooling the pressurized air to the manifold 86.

The means 80 for pressurizing the chamber 74 further includes a passage means 94 for communicating pressurized air from the manifold to the cavity 50. The passage means 94 includes a passage 96 extending from the manifold 86 through the head 16. The vent means 98 for controllably bleeding a portion of the pressurzied air from the chamber 74 includes a restricted bleed passage 100 located in the portion 28 of the cover 26. A conduit 102 connects the exit passage 100 to the air cleaner 84. Alternatively, the bleed passage 100 could controllably bleed a portion of the pressurized air from chamber 74 to the atmosphere.

Figure 2:
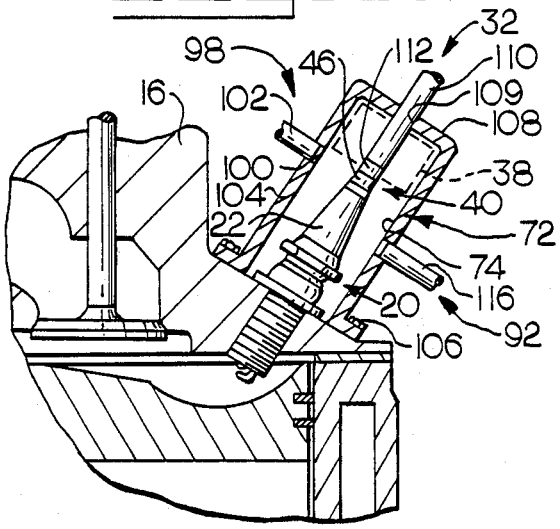
FIG. 2 is an cross sectional view of a first alternative embodiment of the present invention.

Referring now to FIG. 2, a first alternate embodiment of the subject invention is disclosed wherein the means 72 for defining the chamber 74 around at least a portion of the igniter 20 includes a partially tubular element 104 removably secured to the head 16 of the engine 12 by a plurality of bolts 106. The element 104 has an end wall 108 and an aperture 109 extending through the end wall. It is recognized that the element 104 may be sized to encompass several igniters 20 within a single chamber 74. The igniter 20 in this instance is the sparkplug 22.

In this embodiment, the coupling means 40 includes a high tension wire 110 and a connector 112 connecting the wire to the terminal 46 of the sparkplug 22. The terminal 46 and the couplng means 40 are located within the chamber 74. The wire 110 extends from the connector 112 through an aperture 114 in the end wall 106 of the element 104 in a sealable manner to the ignition coil 38 (not shown). It is recognized that the wire 110 could be arranged to pass through the side of the tubular element 104.

It is also recognized that the ignition coil 38 could be connected directly to the terminal 46 of the sparkplug 22 and be located within the chamber 74 as shown by broken lines in FIG. 2.

The passage means 92 includes a conduit 116 connected to element 104 for communicating pressurized air from the manifold (not shown) of the engine 12 to the chamber 74. The restricted bleed passage 100 of the vent means 98 communicates with the chamber 74 for controllably bleeding a portion of the pressurized air from the chamber 74. The conduit 102 connects the passage 100 to the air cleaner (not shown).

Figure 3:
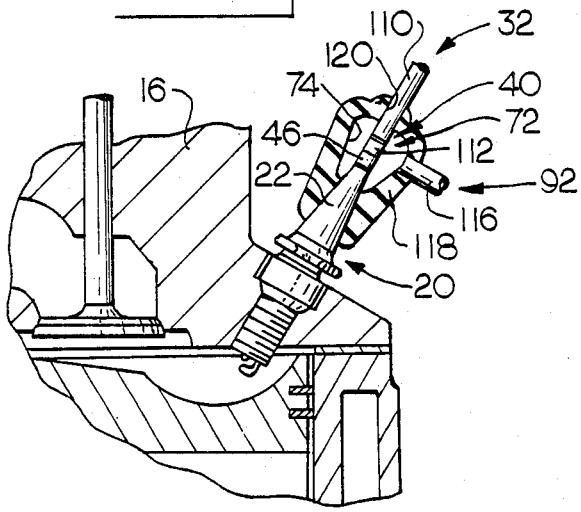
FIG. 3 is an cross sectional view of a second alternative embodiment of the present invention.

Referring now to FIG. 3, a second alternate embodiment of the subject invention is disclosed wherein the means 72 for defining a chamber 74 around at least a portion of the igniter 20 includes a boot 118 connected to the igniter and coaxial therewith. The igniter 20 in this instance is the sparkplug 22 and the boot 118 is sealably connected to the sparkplug. The boot 118 is formed from a material which, for example, is electrically nonconductive. Also in this embodiment, the coupling means 40 includes the high tension wire 110 and the connector 112 connecting the wire to the terminal 46 of the sparkplug 22. The wire 110 extends from the connector 112 through an aperture 120 in the boot 118 in a sealable manner to the ignition coil 38 (not shown). The terminal 46 of the sparkplug 22 and the connector 112 are located within the chamber 74 of the boot 118.

The passage means 92 includes the conduit 116 connected to the boot 118 for communicating pressurized air from the manifold (not shown) of engine 12 to the chamber 74.

As an alternative, the above described pressurized ignition systems could be used with a diesel or turbine engine using a glow plug or another type of igniter.

It is also recognized that arc-over could be suppressed by the pressurization of the chamber 74 with a gas other than air such as Freon or sulfur hexafluroride as the dielectric medium without departing from the subject invention.

INDUSTRIAL APPLICABILITY

The pressurized ignition system 10 of the present invention is particularly adaptable to spark ignited engines.

In operation, referring to FIG. 1, the sparkplug 22 of the engine 12 produces a spark at the electrode 24 and ignites the combustible mixture in the combustion chamber 18. Current passes between the magneto 34 and the coil 38 through the low tension wire 36. A high tension current is transmitted between the coil 38 and the electrode 24 of the sparkplug 22 through the ignition extender 42 that is coupled between the coil and the terminal 46 of the sparkplug.

The air compressor section 82 of the turbocharger 76 pressurizes the air directed to the inlet manifold 86 of the engine 12. The engine aftercooler 92 located in the passage 88 from compressor 82 to the manifold 86 cools the pressurized air being directed to manifold, for example, to approximately 150° F. (63° C.). The compressor 82 typically varies the pressure in the manifold 86 up to a predetermined maximum pressure as a function of the speed of and load on the engine 12. For example, as the speed and load increases, the pressure in the manifold would increase to a predetermined level. Typically, the manifold may be pressurized to approximately two atmospheres [202.6k $N/m^2$ (1520 mm Hg)]dependent on the speed and load of the engine. It is theorized that a range of from $1\frac{1}{2}$ to 3 atmospheres would be optimum.

The passage 96 of the passage means 94 communicates pressurized air from the manifold 86 to the cavity 50 for pressurizing the chamber 74 to a pressure substantially corresponding to the pressure in the manifold.

According to Paschen's Law, the sparking potential between two electrodes in a gas is a function of the product of the gas density and the distance between the electrodes. The dielectric strength of gases can be increased very considerably by increasing the pressure (and hence the density). At moderate pressures, the increase in strength is slightly less than proportional to the pressure. Pressurizing the chamber 74 to a pressure above atmospheric pressure increases the density and therefor the dielectric strength of the air. With the increase in the dielectric strength of the air, the arc-over resistance of the sparkplug 22 increases, and any tendency of arc-over from the terminal 42 or the coupling means 40 to the engine 12, the means 72 for defining a chamber 74 or the metallic shell 23 of the sparkplug 22 is suppressed.

Since the pressure in the chamber 74 substantially corresponds to the pressure in the manifold 86, it also varies as a function of the speed of and load on the engine 12. The firing voltage to the sparkplug 22 used to create a spark varies proportionally with the speed of and load on the engine 12. Therefore, as the pressure in the manifold 86 increases, the voltage to the sparkplug 22 increases proportionally. Advantageously, the pressure in the chamber 74 and the resulting arc-over resistance of the sparkplug 22 would be the greatest during the period of the greatest high voltage demand.

Suppressing the arc-over allows the use of a higher voltage at the electrode 24 thus eliminating the need for premature replacement of the sparkplug 22 due to electrode erosion.

Also, suppressing the arc-over will allow the engine 12 to be operated at a higher altitude than would otherwise be possible.

Pressurizing the chamber 74 prevents dust, moisture, oil and combustible gases that can affect the service life of the sparkplug 22, the ignition extender 42 and the coil 44 and pirate the system of voltage from entering or collecting in the chamber.

The passage 100 of the vent means 98 controllably bleeds a portion of the pressurized air from the chamber 74. This causes a continuous flow of the cooled air from the aftercooler 74 to be circulated through the chamber 74. The circulation of cooled air in the chamber 74 cools the sparkplug 22, the ignition extender 22 and the coil 44 for extended service life.

While the operation of the pressurized ignition system 10 has been explained with respect to FIG. 1, it is also apparent that such principles are equally applicable to the embodiments of FIGS. 2 and 3. In each case, arc-over is suppressed by pressurizing the chamber 74 around at least a portion of the igniter 20. In the alternative embodiment shown in FIG. 3, the chamber 74 is defined by the boot 118 of nonconductive material sealably connected to the sparkplug 22.

In summary, it can be appreciated that the pressurized ignition system 10 extends the affective service of the igniter 20 or sparkplug 22 because of the substantially high arc-over resistance provided by pressurizing the chamber 74. Pressurizing the chamber 74 to a value of, for example, two atmospheres can be expected to improve the service life by a substantial magnitude by suppressing arc-over in accordance with in Paschen's Law and allowing the use of higher voltages across the electrode 24. Moreover, suppressing the arc-over also permits the engine 12 to be operated at a higher elevation than would otherwise be possible. Further, pressurizing the chamber 74 prevents contaminates such as dust, moisture, oil and combustible gases from entering or collecting in the chamber and affecting operation of the igniter 20, the ignition extender 42, and the coil 44. The bleed passage 100 controllably bleeds a portion of the pressurized air from the chamber 74 to cause cool air to be circulated through the chamber. The circulation of the air advantageously cools the igniter 20, the coupling means 40, and the coil 44 improving the service life of the components.

Other aspects, objects and advantages can be obtained from a study of the drawings, the disclosure and the appended claims.

I claim:

1. A pressurized ignition system for use with an internal combustion engine having an engine air inlet manifold, a cylinder head, a combustion chamber, a sparkplug extending into the combustion chamber and having a terminal, and a source of electrical power including coupling means for electrically connecting the terminal to the source of electrical power comprising:

a partly tubular element for defining a chamber around at least a portion of the sparkplug and connected to the engine in coaxial relation with the sparkplug;

an air compressor drivingly connected to the engine for pressurizing the inlet manifold; and passage means including a passage extending from the inlet manifold through the head to the chamber for communicating pressurized air from the inlet manifold to the chamber for pressurizing the chamber to a pressure above atmospheric pressure so that any tendency for arc-over from one of the terminal and coupling means to one of the engine, the tubular element and the sparkplug is suppressed.

2. The pressurized ignition system of claim 1 wherein the engine includes a turbocharger and the air compressor is a portion of the turbocharger.

3. The pressurized ignition system of claim 1 wherein the air compressor varies the pressure in the chamber up to a predetermined maximum pressure as a function of the speed of and load on the engine.

4. The pressurized ignition system of claim 1 wherein the engine includes an engine aftercooler for cooling the pressurized air to the manifold.

* * * * *